US009890914B2

(12) United States Patent
Hannawa et al.

(10) Patent No.: US 9,890,914 B2
(45) Date of Patent: Feb. 13, 2018

(54) LIGHTING ASSEMBLY

(71) Applicant: RAVES EQUIPMENT COMPANY, Auburn Hills, MI (US)

(72) Inventors: Wael M. Hannawa, West Bloomfield, MI (US); Ramize Sheena, West Bloomfield, MI (US)

(73) Assignee: RAVES EQUIPMENT COMPANY, Auburn Hills, MI (US)

( * ) Notice: Subject to any disclaimer, the term of this patent is extended or adjusted under 35 U.S.C. 154(b) by 35 days.

(21) Appl. No.: 14/762,059

(22) PCT Filed: Jan. 21, 2014

(86) PCT No.: PCT/US2014/012223
§ 371 (c)(1),
(2) Date: Jul. 20, 2015

(87) PCT Pub. No.: WO2014/113766
PCT Pub. Date: Jul. 24, 2014

(65) Prior Publication Data

US 2015/0354765 A1 Dec. 10, 2015

Related U.S. Application Data

(60) Provisional application No. 61/754,053, filed on Jan. 18, 2013.

(51) Int. Cl.
*F21V 33/00* (2006.01)
*F21S 4/00* (2016.01)
(Continued)

(52) U.S. Cl.
CPC ..... *F21S 4/008* (2013.01); *F21S 4/28* (2016.01); *F21V 21/005* (2013.01);
(Continued)

(58) Field of Classification Search
CPC F21S 4/008; F21S 4/28; F21V 21/005; F21V 23/005; F21V 33/0044
(Continued)

(56) References Cited

U.S. PATENT DOCUMENTS 4,653,627 A 3/1987 Hampson et al.
5,167,184 A 12/1992 Rebecchi
(Continued)

FOREIGN PATENT DOCUMENTS

DE 202010011614 U1 11/2010
WO 1998002256 A1 1/1998
WO 2010042186 A2 4/2010

*Primary Examiner* — Bryon T Gyllstrom
(74) *Attorney, Agent, or Firm* — Avery N. Goldstein; Blue Filament Law, LLC

(57) ABSTRACT

A modular track light emitting diode (LED) lighting assembly is provided for improved product lighting in display cases, including refrigeration applications. The modular track LED lighting assembly has a series of LED, including one or more flat LED arranged at an angle to form a lighting spine. In a specific inventive embodiment, the one or more flat LED are arranged at a forty five degree angle. Embodiments of the modular track LED lighting assembly may be configured with a single sided series of light sources or single lighting spine for installation on corners or shelves, or with a double sided series of light sources or lighting spines for mounting on mullions between doors of a display cabinet. The lighting assembly may be powered via battery, or via an alternating current (AC) source that is converted to a direct current (DC) voltage.

12 Claims, 7 Drawing Sheets

(51) Int. Cl.
*F21V 21/005* (2006.01)
*F21V 23/00* (2015.01)
*F21S 4/28* (2016.01)
*A47F 3/00* (2006.01)

(52) U.S. Cl.
CPC ..... *F21V 23/005* (2013.01); *F21V 33/0044* (2013.01); *A47F 3/001* (2013.01)

(58) Field of Classification Search
USPC ..... 362/92
See application file for complete search history.

(56) References Cited

U.S. PATENT DOCUMENTS 5,361,913 A 11/1994 Melchionna
5,465,822 A 11/1995 DeWoolfson et al.
5,477,953 A 12/1995 Powell et al.
5,630,493 A 5/1997 DeWoolfson et al.
5,860,503 A 1/1999 Hanserud et al.
5,879,070 A 3/1999 Severloh
5,918,721 A 7/1999 Weinberger
6,302,557 B1 10/2001 Santosuosso et al.
6,578,978 B1 6/2003 Upton et al.
6,578,979 B2 * 6/2003 Truttmann-Battig ... F21S 6/005 362/238
6,606,832 B2 8/2003 Richardson et al.
7,285,903 B2 * 10/2007 Cull ..... G02F 1/133603 313/500
7,754,990 B2 7/2010 Saether
7,824,056 B2 11/2010 Madireddi et al.
7,862,195 B2 1/2011 Stack et al.
7,908,031 B2 3/2011 Saether et al.
7,954,979 B2 6/2011 Sommers et al.
8,002,434 B2 8/2011 Sommers et al.
8,070,305 B2 * 12/2011 Bratton ..... A47F 3/001 362/217.05
8,128,251 B2 3/2012 Huang et al.
8,201,977 B2 6/2012 Thomas et al.
2002/0078654 A1 6/2002 Richardson et al.
2003/0010598 A1 1/2003 Kiva et al.
2003/0137828 A1 * 7/2003 Ter-Hovhannisian .. A47F 3/001 362/92
2005/0265019 A1 * 12/2005 Sommers ..... A47F 3/001 362/217.16
2007/0086198 A1 * 4/2007 Wilson ..... F21S 8/033 362/382
2007/0195535 A1 * 8/2007 Artwohl ..... A47F 3/001 362/341
2008/0158858 A1 * 7/2008 Madireddi ..... A47F 3/001 362/92
2008/0165526 A1 * 7/2008 Saraiji ..... A47F 3/001 362/125
2008/0306813 A1 12/2008 Romansky
2010/0097780 A1 * 4/2010 Beatenbough ..... A47F 3/001 362/92
2010/0103672 A1 * 4/2010 Thomas ..... F21S 4/008 362/235
2011/0051401 A1 * 3/2011 Bauer ..... F21S 4/28 362/125
2011/0055059 A1 3/2011 Sahai
2011/0096533 A1 * 4/2011 Sekela ..... A47F 3/001 362/125
2011/0145173 A1 6/2011 Hunscher et al.
2012/0063125 A1 3/2012 Quaal et al.
2012/0170258 A1 * 7/2012 VanDuinen ..... F21V 19/0045 362/217.02

* cited by examiner

LIGHTING ASSEMBLY

RELATED APPLICATIONS

This application claims priority benefit of US Provisional Application Ser. No. 61/754,053 filed Jan. 18, 2013; the contents of which are hereby incorporated by reference.

FIELD OF THE INVENTION

The present invention in general relates to the field of lighting and in particular to a lighting assembly suitable for use in display cases.

BACKGROUND OF THE INVENTION

Commercial refrigerators and refrigerated display cases (coolers and freezers) are used in markets, food-vending operations, liquor stores for the preservation of freshness and attractive display of product to the customer. Typically, commercial display cases have frames defining a rectangular opening for the case which is accessed through sliding doors or swing doors having large areas of multi-layered glazing to permit the customer to see, select and access the refrigerated product easily, while preventing heat transfer into the refrigerated space. The display case frame includes an upper frame member, a lower frame member, two laterally spaced side frame members extending vertically between the upper and the lower frame members, and one or more mullions which extend vertically between the upper frame member and the lower frame member and connected thereto. The mullion provides support for the cabinet frame, associated doors, and also provides a sealing surface against which portions of the door assemblies engage and seal for effective sealing of the refrigerated cabinet. Typically, mullions are also equipped with electrical conduits for delivering electrical power to anti-condensation devices for the door assemblies and for a fluorescent lighting fixture associated with the mullion.

Conventional refrigerated display cases typically include a fluorescent light source to illuminate the product display area. Some refrigerated display cases include fluorescent light sources coupled to a canopy of the refrigerated display cases to direct light generally downward onto the food product in the product display area. These refrigerated display cases also may include fluorescent light sources attached to shelves in the product display area. Generally, the fluorescent light sources used in conventional refrigerated merchandisers are relatively large, and can reduce the amount of space in the refrigerated merchandiser that can be allocated to displaying food product. Fluorescent light sources also generate heat which causes the refrigeration unit to work harder and consume more energy.

Furthermore, the effectiveness of fluorescent light sources is dependent on the temperature of the application where the fluorescent light sources are used. In colder temperature conditions, the fluorescent light source has less light output than in application of the fluorescent light source in warmer temperature conditions. As a result, fluorescent light sources within the refrigerated display cases have substantially reduced effective illumination of the products within the product display area. Additionally, at lower operating temperatures initiating the required arc to illuminate a fluorescent tube is difficult.

Known lighting assemblies often also suffer from a number of problems when it comes to lighting display cases including issues pertaining to efficiency, lighting uniformity, consumer appeal, customization, and maintenance. Lighting assemblies often allow light to escape the display case and bleed out into the external environment. However, this escaping light could be put to better use lighting the item(s) on display, whereby less powerful and/or or fewer light sources could be employed. Further, lighting assemblies generally do not uniformly light a display case. For example, such assemblies generally fail to direct enough light to the center of a display case, resulting in much higher luminance in front of a mullion, as compared to the center of the display case. However, uniform luminance is preferable as it makes more efficient use of the available luminance and may allow fewer light sources and/or less powerful light sources.

Recently, fluorescent light sources have begun to be phased out in favor light emitting diodes (LED) technology. Fluorescent tubes are relatively inefficient by comparison to LEDs, since fluorescent tubes produce more heat than LEDs and LEDs provide more control over the direction of light provided. Fluorescent tubes do not have nearly as long an operating life as typical LED.

Thus, there exists a need for modular track LED lighting that provides for improved product lighting in display cases, including refrigeration applications.

SUMMARY OF THE INVENTION

A modular track lighting assembly for display cases is provided that includes an elongated support structure that encloses a printed circuit board; one or more lighting spines supported at an angle by the elongated support structure, where the lighting spines face away from each other; one or more light emitting diodes (LED) individually mounted at a second angle on the one or more lighting spines; a set of mounting brackets joined to the elongated support; one or more lenses enclosing the one or more lighting spines; a pair of end caps at opposing ends of the assembly that seal the assembly; and wherein the printed circuit board is in electrical communication with the lighting spines.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings wherein like reference numerals refer to like parts throughout the several views, and in which:

DESCRIPTION OF THE INVENTION

The present invention has utility as a modular track light emitting diode (LED) lighting assembly that provides for improved product lighting in display cases, including refrigeration applications. Embodiments of the modular track LED lighting assembly have a series of LED, including one or more flat LED arranged at an angle to form a lighting spine. In a specific inventive embodiment, the one or more flat LED are arranged at a forty five degree angle. Embodiments of the modular track LED lighting assembly may be configured with a single sided series of light sources or single lighting spine for installation on corners or shelves, or with a double sided series of light sources or lighting spines for mounting on mullions between doors of a display cabinet. Embodiments of the lighting assembly may be powered via battery, or via an alternating current (AC) source that is converted to a direct current (DC) voltage.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Figure 1:
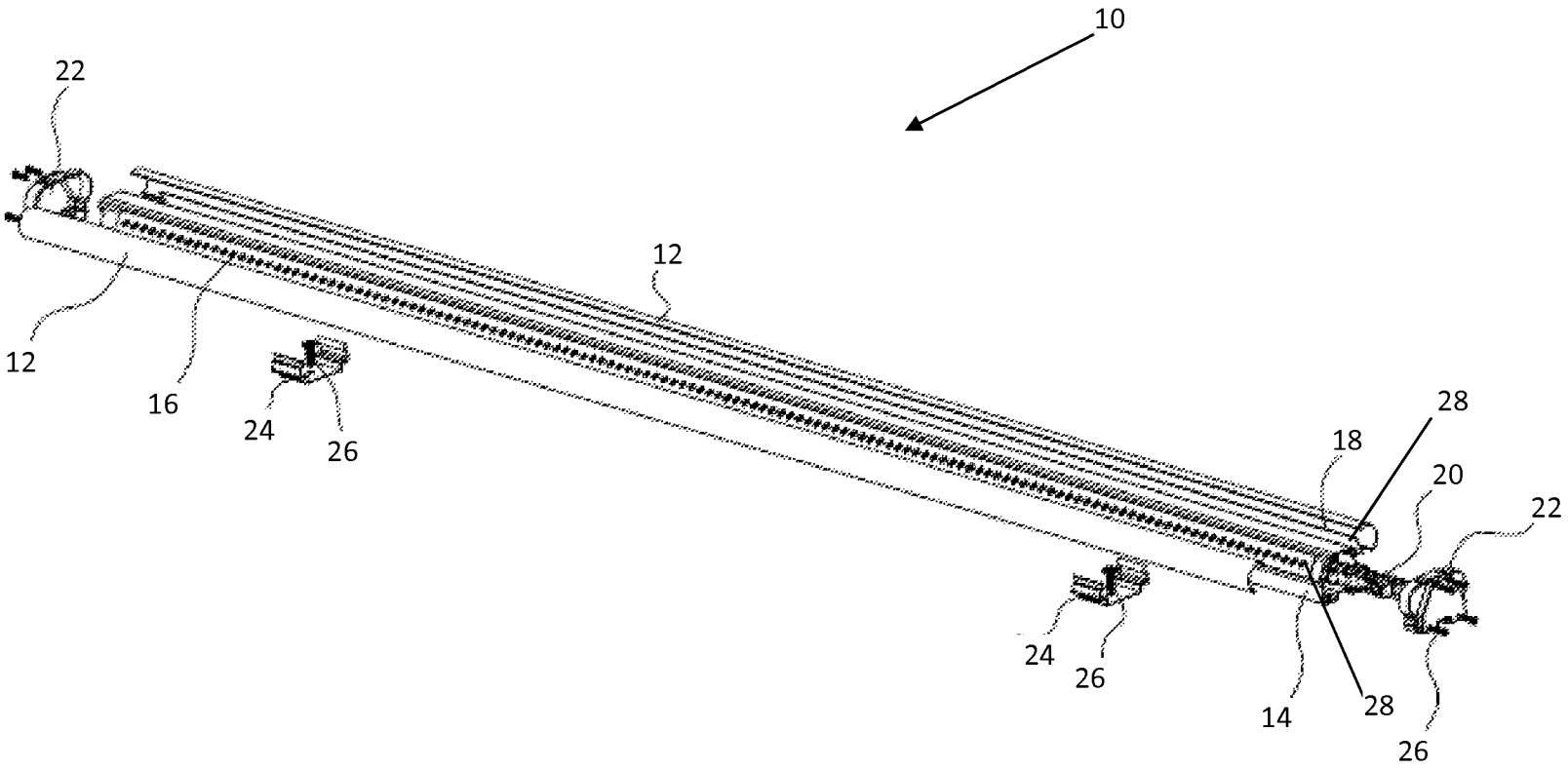
FIG. 1 is an exploded perspective view of an embodiment of a double sided modular lighting assembly.
Figure 2A:
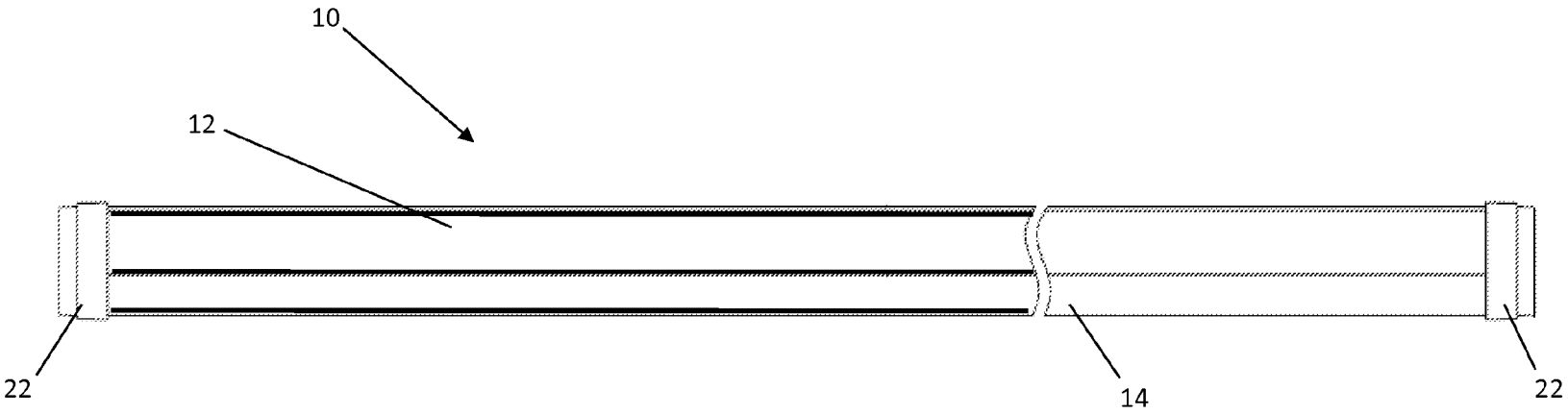
FIG. 2A is a is a plan view of the embodiment of the double sided modular lighting assembly of FIG. 1.
Figure 2B:
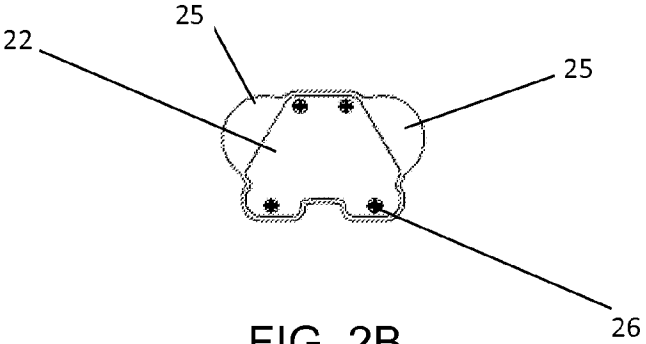
FIG. 2B is a plan view of the embodiment of one of the end caps of FIG. 1.
Figure 5:
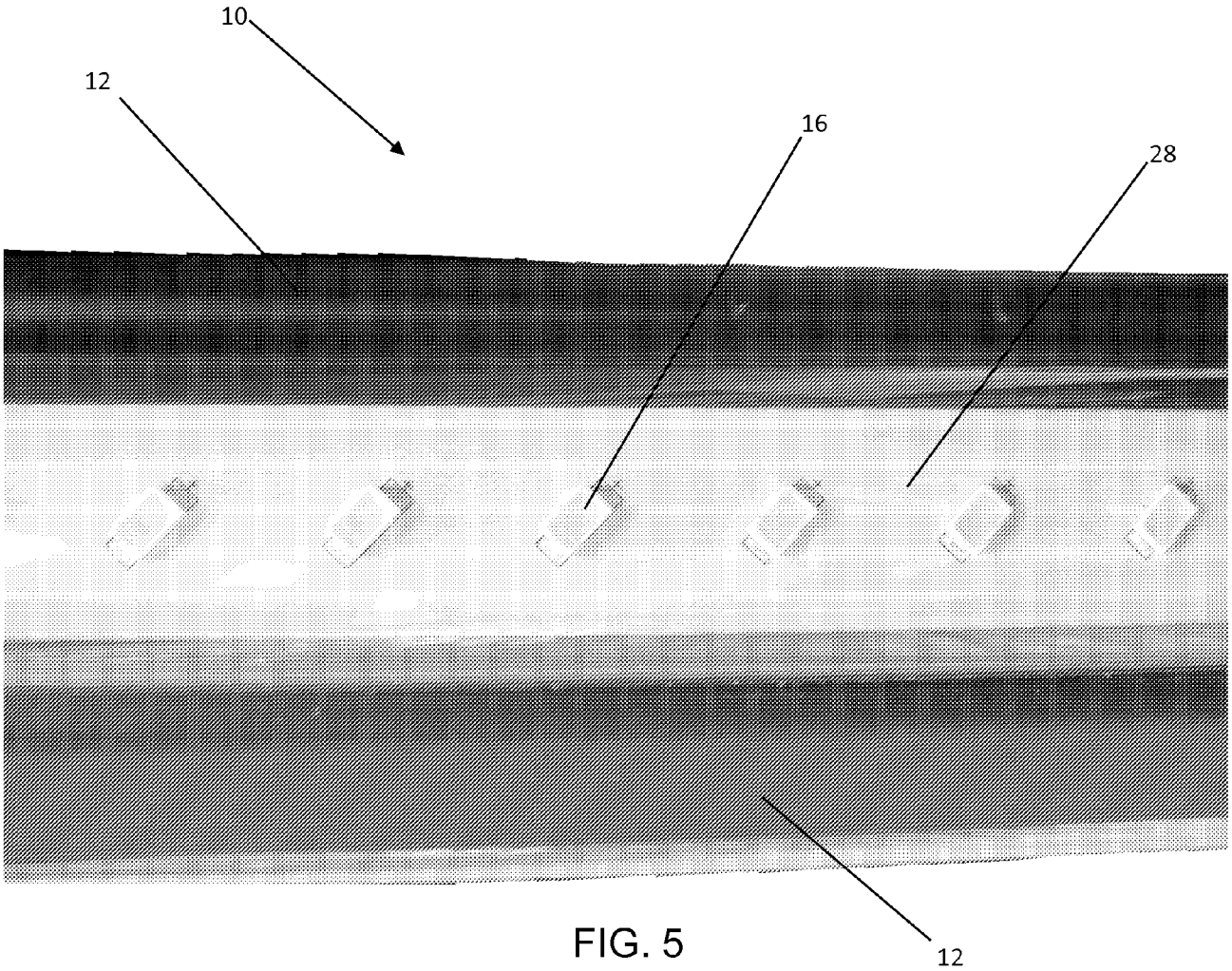
FIG. 5 is top sectional view of LEDs arranged on a lighting spine of the double sided modular lighting assembly of FIG. 1.
Figure 6:
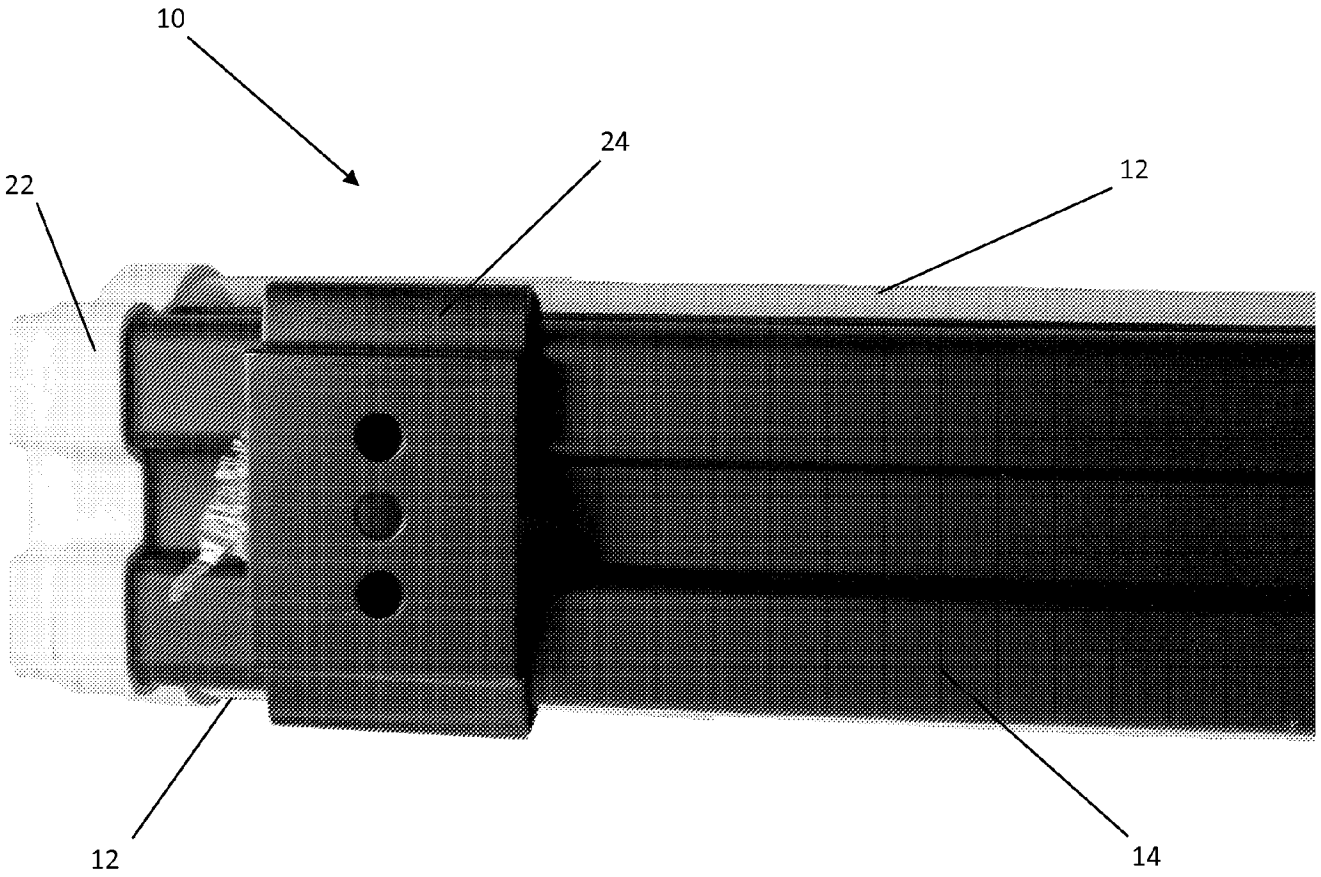
FIG. 6 is a rear partial view of the double sided modular lighting assembly of FIG. 1 illustrating one of the mounting brackets.

With reference to the attached figures, an inventive modular track double sided LED lighting assembly is depicted generally at 10 in FIG. 1. The modular track double sided lighting assembly 10 is formed from with an elongated support structure 14 that encloses a printed circuit board 20. The elongated support structure 14 may be made of metal, plastic, or a composite material. The printed circuit board 20 distributes power to lighting spines 28 that is optionally supplied by on-board batteries, or is configured with an AC to DC converter. The lighting spines 28 are supported at an angle between thirty and sixty degrees by the elongated support structure 14, where the lighting spines 28 face away from each other. In an embodiment, the lighting spines 28 are supported at a forty five degree angle by the elongated support structure 14. The lighting spines 28 have one or more LEDs 16 mounted to the lighting spines 28. In a specific inventive embodiment, the LEDs 16 are mounted at a forty five degree angle as shown in FIG. 5. Lenses 12 cover and seal the lighting spines 28. The lenses 12 may be clear, colored, or opaque. The lenses 12 may have a curved or straight surface. The lighting assembly 10 has end caps 22 that are joined to the assembly 10 with fasteners 26, and the end caps 22 act to seal the assembly 10. Mounting brackets 24 attached to the lighting assembly 10 with fastener 26 are used to secure the lighting assembly 10 to a mullion. FIG. 2A is a is a side plan view of the embodiment of the double sided modular lighting assembly of FIG. 1, and FIG. 2B is a front plan view of the embodiment of one of the end caps 22 that shows the curved areas 25 that accommodate the two curved lenses 12 of the double sided LED lighting assembly 10. FIG. 6 shows a rear sectional view of the lighting assembly 10 that shows the rear portion of the elongated support structure 14 with the end cap 22 and mounting bracket 14.

Figure 3:
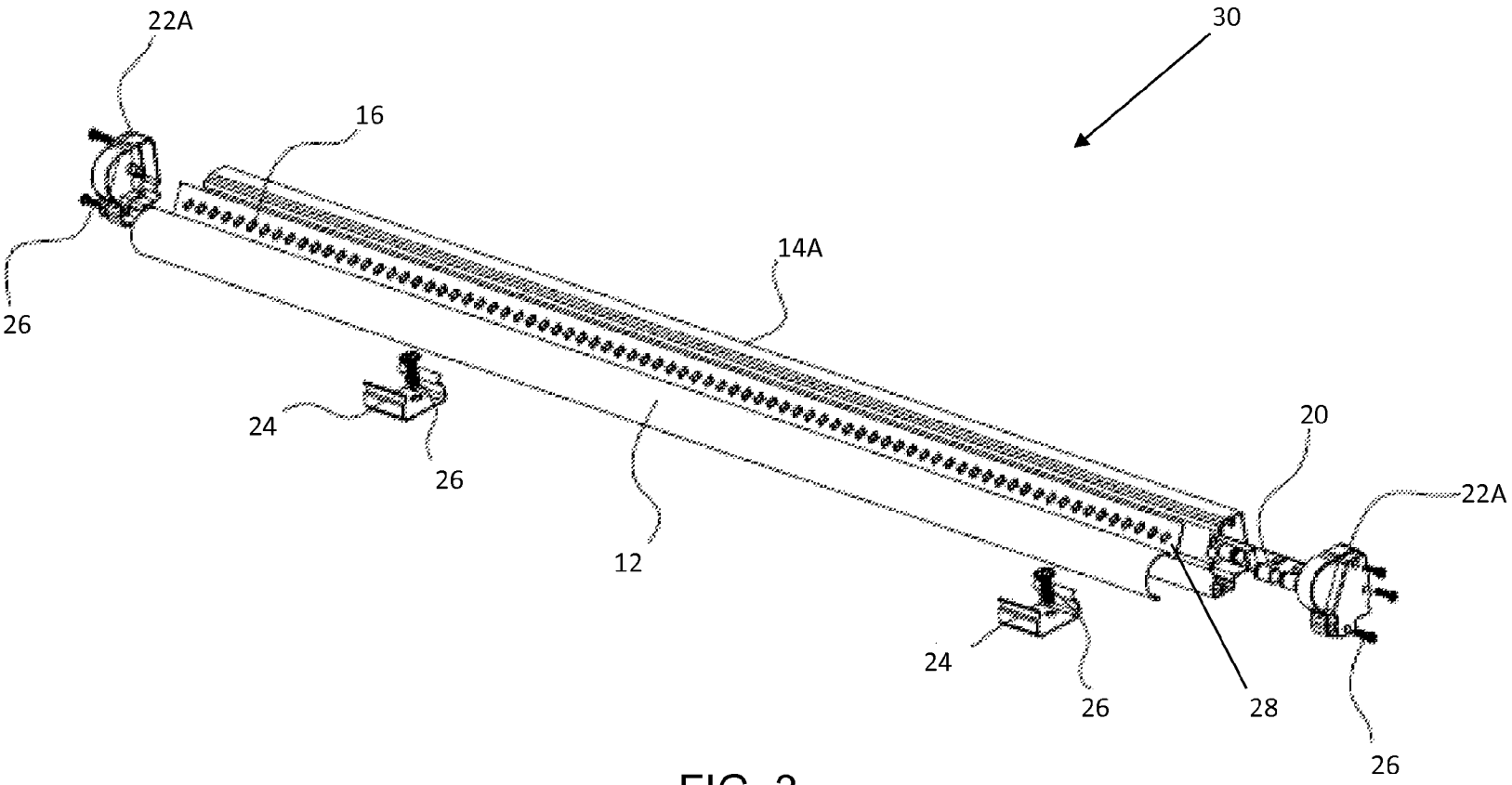
FIG. 3 is an exploded perspective view of an embodiment of a single sided modular lighting assembly.
Figure 4A:
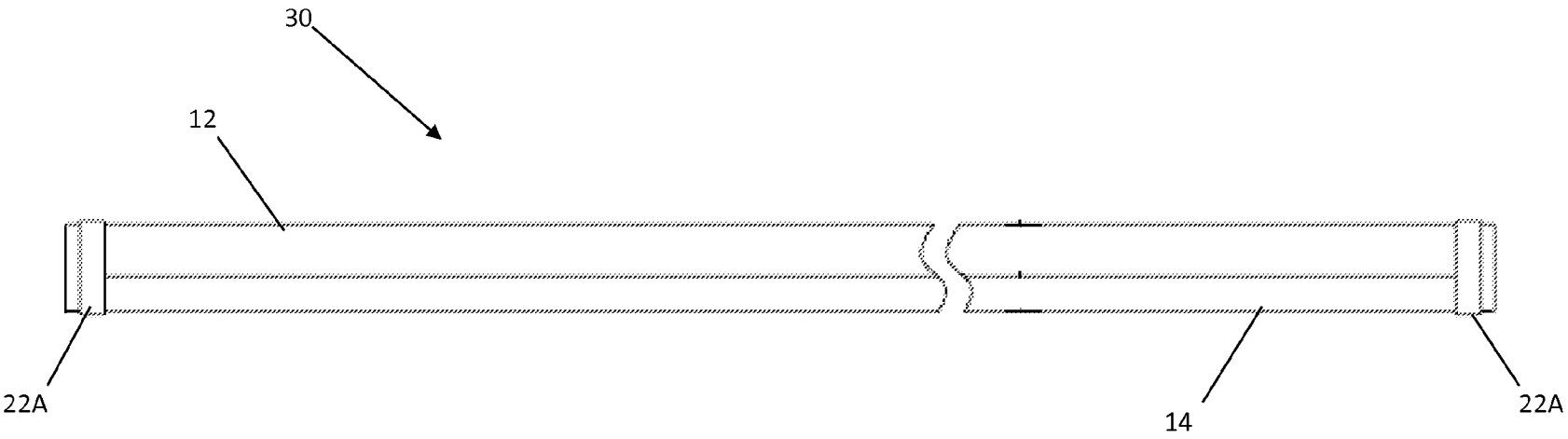
FIG. 4A is a is a plan view of the embodiment of the single sided modular lighting assembly of FIG. 3.
Figure 4B:
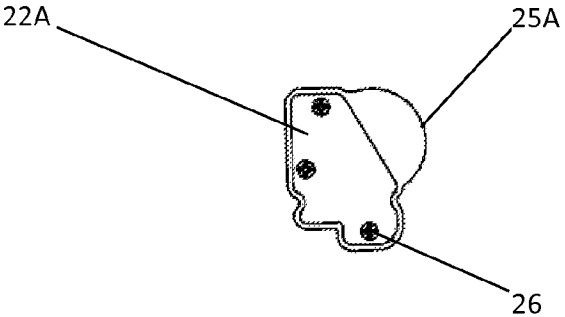
FIG. 4B is a plan view of the embodiment of one of the end caps of FIG. 3.

FIG. 3 is an exploded perspective view of an embodiment of a single sided modular lighting assembly 30. The single sided modular lighting assembly 30 is formed with an elongated support structure 14A that encloses the printed circuit board 20. The elongated support structure may be made of metal, plastic, or a composite material. The printed circuit board 20 distributes power to a single lighting spine 28 that is optionally supplied by on board batteries, or is configured with an AC to DC converter. The single lighting spine 28 is supported at an angle between thirty and sixty degrees by elongated support structure 14A. In an embodiment, the lighting spine 28 is supported at a forty five degree angle by the elongated support structure 14A. The lighting spine 28 has one or more LEDs 16 mounted to the lighting spine 28. In an embodiment the LEDs 16 are mounted at an angle of between 35 and 60 degrees, as shown in FIG. 5 for the specific example of a 45 degree angle. A single lens 12 covers and seals the lighting spine 28. The lens 12 may be clear, colored, or opaque. The lens 12 may have a curved or straight surface. The lighting assembly 30 has end caps 22A that are joined to the assembly 30 with fasteners 26, and the end caps 22A act to seal the assembly 30. Mounting brackets 24 attached to the lighting assembly 30 with fastener 26 are used to secure the lighting assembly 30 to a mullion. FIG. 4A is a is a side plan view of the embodiment of the single sided modular lighting assembly of FIG. 3, and FIG. 4B is a front plan view of the embodiment of one of the end caps 22A that shows the single curved area 25A that accommodate the single curved lens 12 of the single sided LED lighting assembly 30.

Figure 7:
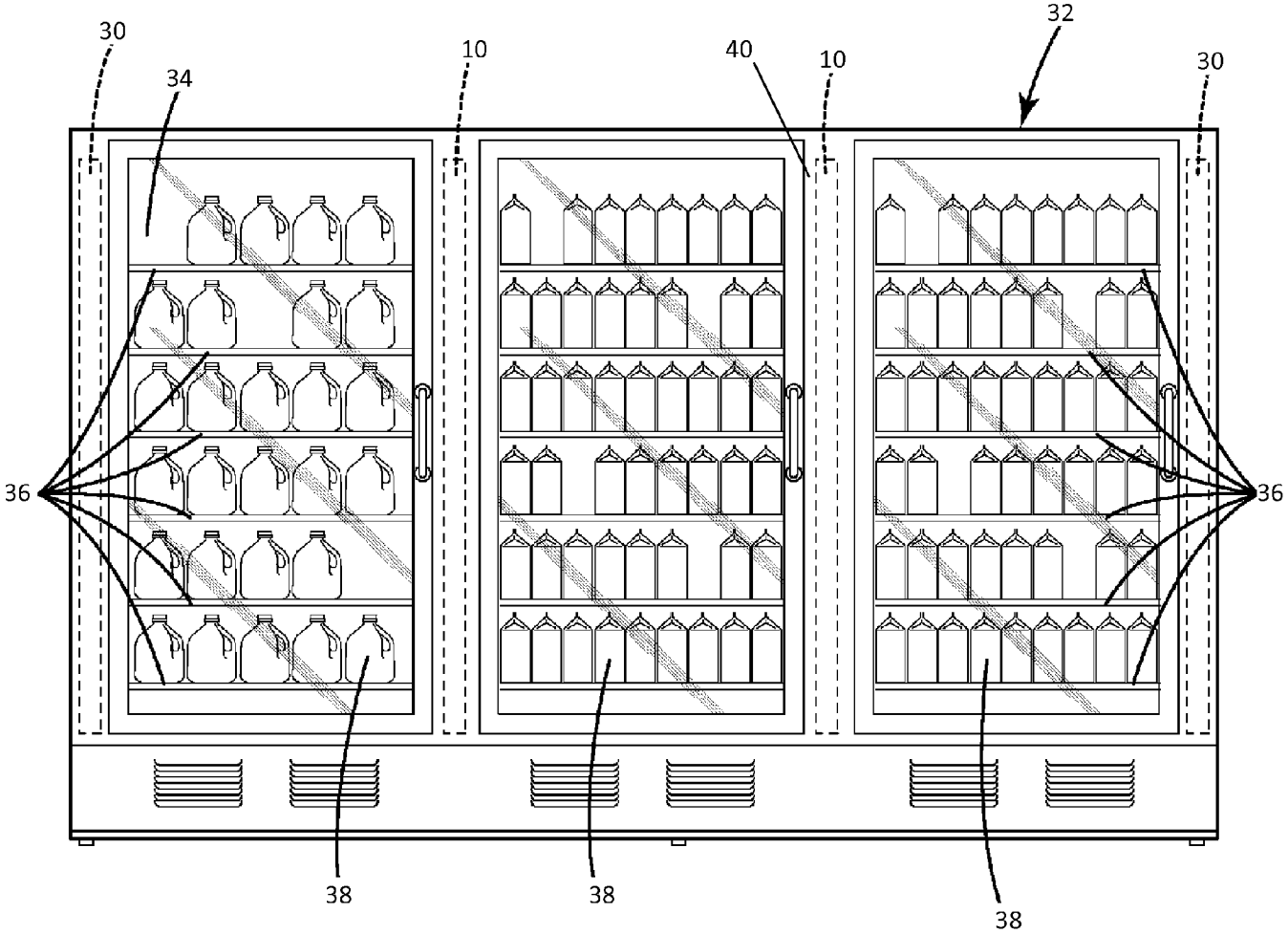
FIG. 7 is a plan view of a commercial refrigeration display case.

FIG. 7 is a plan view of a commercial refrigeration display case 32 enclosed by window doors 34 with shelving 36 for display of products 38. Single sided modular lighting assembly 30 is positioned on the ends of the display case 32, and double sided lighting assembly 10 are positioned on the mullions 40.

The foregoing description is illustrative of particular embodiments of the invention, but is not meant to be a limitation upon the practice thereof. The following claims, including all equivalents thereof, are intended to define the scope of the invention.

The invention claimed is:

1. A display case having a modular track lighting assembly comprising:

a volume adapted to be refrigerated and bounded by a transparent door adjacent to a vertical mullion;

said modular track lighting assembly mounted to said mullion and comprising:

an elongated support structure that encloses a printed circuit board (PCB) and joined to said mullion with fasteners;

one or two lighting spines supported at an angle by said elongated support structure, wherein said lighting spines are supported at an angle of between thirty and sixty degrees by said elongated support structure and where the two lighting spines face away from each other;

a plurality of light emitting diodes (LEDs) individually mounted on each of said one or two lighting spines;

a set of mounting brackets joined to said elongated support;

a separate curved lens enclosing each of said one or two lighting spines;

a first and second end cap at opposing ends of said modular track lighting assembly that seal said assembly; and wherein said printed circuit board is in electrical communication with said lighting spines and is removable from internal within said elongated support structure with removal of said first end cap.

2. The display case of claim 1 wherein said elongated support structure is made of metal, plastic, or a composite material.

3. The display case of claim 1 wherein said printed circuit board distributes power to said one or two lighting spines where the power is supplied by on-board batteries.

4. The display case of claim 1 wherein said printed circuit board distributes power to said one or two lighting spines where the power is supplied by an AC to DC converter.

5. The display case of claim 1 wherein said angle is between thirty five and sixty degrees.

6. The display case of claim 1 wherein said one or more LED are flat LED.

7. The display case of claim 1 wherein said angle is 45 degrees.

8. The display case of claim 1 wherein said separate lens is clear, colored, or opaque.

9. The display case of claim 1 wherein said separate lens is curved or straight surfaces.

10. The display case of claim 1 wherein said display cases are refrigeration units.

11. The display case of claim 1 configured as a single sided series of light sources wherein said one or two lighting spines is one lighting spine.

12. The display case of claim 1 configured as a double sided series of light sources wherein said one or two lighting spines are two lighting spines that face away from each other and another transparent door is in opposition to said transparent door.

* * * * *